US005885305A

United States Patent [19]

Van Wersch

[11] Patent Number: 5,885,305

[45] Date of Patent: Mar. 23, 1999

[54] DEVICE FOR FIXING DYE IN REACTIVE DYEING

[75] Inventor: Kurt Van Wersch, Wegberg, Germany

[73] Assignee: A. Monforts Textilmaschinen GmbH & Co., Monchen-Gladbach, Germany

[21] Appl. No.: 860,073

[22] PCT Filed: Oct. 8, 1996

[86] PCT No.: PCT/DE96/01929

§ 371 Date: Jun. 12, 1997

§ 102(e) Date: Jun. 12, 1997

[87] PCT Pub. No.: WO97/14839

PCT Pub. Date: Apr. 24, 1997

[30] Foreign Application Priority Data

Oct. 16, 1995 [DE] Germany ..... 195 38 429.6

[51] Int. Cl.[6] ..... D06B 3/10

[52] U.S. Cl. ..... 8/149.3; 8/151; 68/5 D; 34/652

[58] Field of Search ..... 68/5 D, 5 E, 5 C; 18/205 R, 202; 8/149.3, 151; 116/324, 325; 34/557, 629, 647, 652

[56] References Cited

U.S. PATENT DOCUMENTS

| | | | |
|---|---|---|---|
| 2,437,680 | 3/1948 | Cornelius . | |
| 3,041,863 | 7/1962 | Goto . | |
| 3,712,086 | 1/1973 | Payet et al. . | |
| 3,945,225 | 3/1976 | McCoy | 68/5 D |
| 3,954,404 | 5/1976 | Childers et al. | 8/151 |
| 4,055,971 | 11/1977 | Hermes | 68/205 R |
| 4,338,282 | 7/1982 | Motooka et al. | 68/5 D |
| 4,642,164 | 2/1987 | Hanhikoski et al. | 8/149.3 |
| 4,809,378 | 3/1989 | Reidel | 8/149.3 |
| 5,014,380 | 5/1991 | Enderlin | 8/149.3 |
| 5,050,258 | 9/1991 | Fischer et al. | 8/151 |
| 5,408,715 | 4/1995 | Keller et al. | 68/5 D |
| 5,493,744 | 2/1996 | Beckstein et al. | 68/5 D |
| 5,704,230 | 1/1998 | McClain et al. | 68/5 D |

FOREIGN PATENT DOCUMENTS

| | | | |
|---|---|---|---|
| 0 087 740 | 2/1983 | European Pat. Off. . | |
| 1 460 769 | 2/1965 | Germany . | |
| 25 52 562 | 11/1975 | Germany . | |
| 26 58 863 | 12/1976 | Germany . | |
| 60-245136 | 12/1985 | Japan | 68/149.3 |
| 1-148868 | 6/1989 | Japan . | |

OTHER PUBLICATIONS

European Patent Application 333,964 68/5D Sep. 1989.

Agrait, N., "Vertical Inertial Piezoelectric Translation Device for a Scanning Tunneling Microscope," Jan. 1992, Rev. Sci. Instrum. 63 (1),pp. 263–264.

*Primary Examiner*—Frankie L. Stinson

[57] ABSTRACT

A device is provided by the invention, with which it is possible to execute a method for the dye fixation in reactive dyeing of cellulose goods or cellulose fibers of all types in a dye liquor containing auxiliaries for binding the reactive dye to the cellulose fibers, wherein in an air dryer the cellulose goods which are padded with the dye liquor can be subjected to a retentive treatment of predetermined length with a predetermined steam content of the air in the drying chamber. In the device the residual moisture of the cellulose goods is maintained at a value as far as the outlet of the chamber in which the reaction of the dyestuff with cellulose fibers takes place. A defined steam content of the chamber air can simultaneously be continuously—even with light goods—regulated independently of the weight of the goods, i.e. also independently of the amount of water brought into the dryer with the goods.

15 Claims, 1 Drawing Sheet

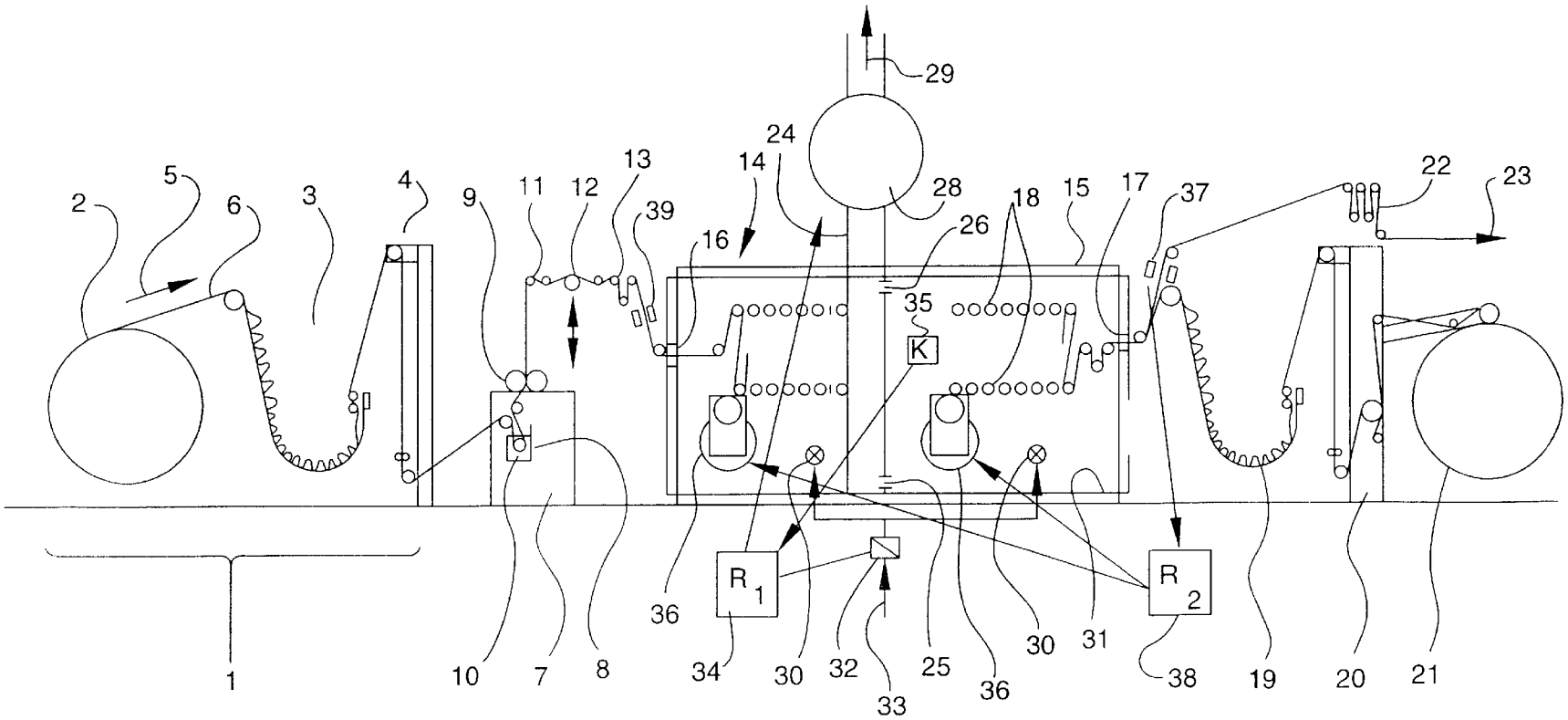
1
2
3
4
5
6
7
8
9
10
11
12
13
14
15
16
17
18
19
20
21
22
23
24
25
26
28
29
30
31
32
33
34
35
36
37
38
39
K
R 1
R 2

DEVICE FOR FIXING DYE IN REACTIVE DYEING

The invention relates to a device for dye fixing in connection with reactive dyeing of cellulose goods, with a padding machine for applying a dye liquor containing the reactive dyestuff to the goods, and with an air dryer connected downstream of the padding machine having a chamber with a goods inlet and outlet, as well as a controllable draw-off conduit and a controllable recirculating fan. The recirculating fan preferably aspirates the air via a heating register with the aid of a ventilator. The ventilator and/or heating register can be controllable. It is therefore also possible to call this a recirculating heating fan.

The device is preferably intended to perform a reactive dye process by means of a dye liquor containing auxiliaries for binding the reactive dyestuff to the cellulose fibers. Within the framework of the invention the term "cellulose goods" includes textile goods webs made of cellulose yarn or fibers, including cotton, viscose, PES/viscose, PES/co, viscose/wool, PA/wool, modal fibers and the like. If it is stated that the air dryer has a chamber for inserting and removing the goods, as well as a draw-off conduit and recirculating fan, this also includes a plurality of at least two chambers with inlets and outlets and/or a plurality of at least two draw-off conduits and recirculating fans per chamber.

Today, mainly four methods are employed world-wide for the continuous dyeing of mesh or woven goods, for example also made of 100% cellulose, with reactive dyestuffs, namely the pad-batch method with a cold retention time between padding and washing, the pad-dry thermo-fixing method with a drying and a hot-air fixation passage between padding and washing, the pad-steam method with a steam passage between padding and washing, and the pad-dry-pad steam method with an intermediate drying stage and a steam stage between padding and washing.

The reactive dyestuffs being used can be classified by the strength of their reactivity. The reactivity of the dyestuffs has an effect on the length of the retention time in connection with the pad-batch method, on the temperature and time in connection with the pad-dry thermo-fixing method, and on the temperature as well as time in connection with the pad-dry-pad steam process. The amount of dye yield and/or of the degree of fixation are functions of reactivity. The dyes which can also be employed in cold dyeing systems at 40° C. also have a reactivity increasing in the following series: monochlorotriazine, vinyl sulfone, dichloroquinine oxaline, monofluorotriazine, difluorochloropyrimidine and dichlorotriazine.

To bind the reactive dye to the fibers, the most diverse types and amounts of auxiliaries are recommended by the dye manufacturers, depending on the method. For example, with the pad-batch method, up to 30 g/l of sodium carbonate, 35 ml/l of NaOH 38° Bé, 70 ml/l of water glass 37° to 40° Bé and 80 g/l of urea are possible. With the bad-dry thermo-fixing method up to 30 g/l of sodium carbonate, 5 g/l of common salt, 20 g/l of sodium bicarbonate and 200 g/l of urea are used, and with the pad-steam method and the pad-dry-pad steam method up to 30 g/l of sodium carbonate, 20 ml/l of NaOH 38° Bé and 250 g/l of common salt/Glauber's salt. These auxiliaries, in particular soda lye, water glass, sodium carbonate, urea and common salt, which are used in relatively large amounts, partially get into the exhaust air, but to the greatest part into the waste water during the washing process following dye fixation.

In a desire to prevent the burden on the exhaust air and waste water during the reactive dyeing of cellulose goods, to reduce the required machinery and to perform the dyeing process with a reduced use of energy over a shorter time, the inventor arrived at the realization to connect the reactivity of the dyestuffs themselves with the drying behavior of the treated goods in such a way that an optimal dyeing yield can be achieved without the large or aggressive amounts of auxiliaries, such as urea, water glass, sodium carbonate, soda lye and/or common salt.

Accordingly it is the object of the invention to provide a device which permits the connection of the reactivity of the dyestuffs used with the drying behavior of these goods in such a way that an optimal dyeing can already be achieved without the mentioned amounts of aggressive auxiliaries in a combined—preferably continuous—retention and drying process.

In connection with the device described at the outset, with an air dryer having a chamber with an inlet and outlet for goods as well as a controllable draw-off conduit and a controllable recirculating fan, this object is attained in that the chamber has controllable steam injectors, that a climate measuring device, connected with the control means of the draw-off conduit and the steam injectors, is provided for regulating a preset steam content of the ambient air, and that at the goods outlet an outlet measuring device for the residual outlet moisture is assigned to the goods in controlled connection with the recirculating fan for regulating a residual moisture of the goods still capable of reacting up to the goods outlet.

In accordance with the invention it is achieved that a defined steam content of the air is maintained in the chamber or the air dryer and that care is taken that at the outlet from the chamber the goods still have a residual moisture capable of reacting. It is simultaneously achieved that, regardless of the weight of the goods, i.e. also independently of the amount of water brought into the dryer or the chamber with the goods, a defined preset steam content of the air in the chamber can be regulated continuously, even with the lightest goods.

In actual use it was noted, among other things, that a dyeing liquor which, besides the respective reactive dye, contains as auxiliaries (for binding the dyestuff to the cellulose fibers) exclusively wetting agents and sodium bicarbonate ($NaHCO_3$), or a similar weak alkali, provides excellent dyeing results if the cellulose goods soaked with the liquor are fixed in an air dryer by a retentive treatment of a magnitude of the length on the order of two minutes and a steam content of the air of a magnitude on the order of 25 vol-%. During tests the numerical value could vary by 1 to 3 minutes and more and between 15 and 50 vol-% and more.

In accordance with the invention, the chamber is intended to have controllable steam injectors. This is understood to mean that the chamber should have means for the controllable injection of steam. Thus, each chamber can have an arbitrary number of steam injectors, including the number one. The steam injectors and their controls should be embodied in such a way that the steam entry can be completely blocked or switched on gradually from zero to a maximum. More or less large amounts of steam are needed, if otherwise the steam content of the chamber air would fall below a predetermined amount. This can occur, for example, if the goods entering the chamber carry too little liquid with it. If, on the other hand, the steam content of the chamber air—in accordance with a measurement by the climate measuring device—is too great, air is drawn out of the draw-off conduit in a regulated manner until the preset steam content (in vol-%) has been set.

Although maintaining the previously mentioned chamber climate is very important for the method, but not sufficient, a predeterminable retention time of the goods in a reaction-ready state must be added. It therefore must be prevented that the goods reach a state prior to the end of the retention time in which the applied dyestuffs can no longer or not sufficiently react with the cellulose fiber or the like. This is generally the case if the minimum residual moisture of the goods falls below—depending on the type of goods—10 to 30% of the weight of the goods.

Therefore, the device in accordance with the invention has a measuring device for the residual moisture, the so-called outlet measuring device for the residual moisture, at the goods outlet of the chamber or shortly after the outlet outside of the chamber, for the appropriate regulation of the chamber climate, by means of which the residual moisture is measured which is still in the goods after they have passed through the chamber. The recirculating fan or recirculating fans of the dryer are controlled as a function of the measured results of this outlet measuring device for the residual moisture in such a way that the drying output of the dryer is reduced, preferably by reducing the rpm of the recirculating fans, until the goods at the chamber outlet have the required minimum of residual moisture.

If the device in accordance with the invention has two or more air dryer chambers arranged in series behind each other, it is generally sufficient to assign a single outlet measuring device for the residual moisture to the chambers at the goods outlet of the last chamber. If it is not certain already at the goods inlet whether the goods have the required residual moisture, an inlet measuring device for the residual moisture can be placed at the inlet of the chamber or chambers. It is possible by means of this device to control, if needed, upstream devices for dunking or wetting the goods with dye liquor or squeezing the dye liquor out and/or moistening the goods.

It is also possible to assign to the goods a dye-measuring system in accordance with EP 0 411 414 B1, which regulates the padding machine, in the area between the padding machine and the chamber inlet. The moisture and dye measuring devices should preferably be combined. This applies in particular, for example, if the measurements are to extend back and forth over the width of the goods or web of goods.

After the above it can be stated that the device in accordance with the invention preferably has—except for the regulation of the dye distribution in accordance with EP 0 411 414 B1—two control circuits, namely a first control circuit with a first control for regulating the amount of recirculated air and therefore the dryer output chamber temperature by means of the recirculating fan as a function of the initial residual moisture of the goods, and a second control circuit for regulating the chamber climate by the selective triggering of a ventilator in the draw-off conduit or a valve for blowing in steam by means of the steam injectors as a function of the climate measurement in the chamber.

In the device in accordance with the invention the aggressive or environmentally damaging auxiliaries formerly employed in dyeing processes are substituted, so to speak, by a controlled steam content during drying. It is possible in individual cases to work with dye liquors which only contain approximately 1 to 2 g/l of a wetting agent and approximately 10 g/l of sodium bicarbonate. The dye results are the better, the greater the reaction capability of the employed dyestuffs is. Reactive materials on the basis of dichlorotriazine have been shown to be particularly advantageous in this respect. Improvements and further embodiments of the invention are recited in the dependent claims.

Details of the invention will be explained by means of the schematic representation of an exemplary embodiment.

BRIEF DESCRIPTION OF THE DRAWING

FIG. 1 is a schematic representation of the device of the present invention for fixing dyeing in reactive dyeing of cellulose goods.

This represented installation has an inlet area 1 with a mandrel 2, a trough 3 and a high inlet 4. Following the through 3, the textile goods web 8 running in the conveying direction 5 is guided to a dye padding machine 7 with a liquor trough 8 and a squeezer 9, is provided with dye liquor 10 and evenly dewatered in the squeezer 9. Following a brief air passage 11—if required with a moistening device 12—and possibly with a compensator 13, the goods web 6 is conducted to an air dryer which, in the exemplary embodiment, is a hot flue 14. The goods content of the hot flue should be of sufficient size so that the retention time preferred in accordance with the invention can be maintained.

At the start-up of the installation the moistening device 12 is preferably used for moistening an end cloth/feeder, and for establishing the required chamber climate inside the chamber 15 enclosing the hot flue 14. The chamber 15 has a goods inlet 16 and a goods outlet 17. In the exemplary embodiment, two rows of guidance and conveying rollers 18 are located in the chamber, over which the goods web 6 is guided in meanders. After the goods outlet 17, the goods web 6 treated in the hot flue 14 can, for example, be wound on a mandrel 21 via a trough 19, a high outlet 20, or it can be directly guided via a compensator 22 to a washing machine 23 or the like.

Characteristics preferred within the framework of the invention are a draw-off conduit 24, which can have floor inlets 25 and ceiling inlets 26 inside the chamber 15 and which has a ventilator 28 with a frequency- or rpm-regulated motor at its outlet 27. In accordance with the regulation of the exhaust air ventilator motor, the draw-off conduit therefore can draw off more or less, or no exhaust air at all from the chamber 15. This regulation can basically also take place by the control of the associated heat register or its heating medium. The ventilator motor reacts to possible control commands, but generally more resiliently than a heater.

A further preferred characteristic of the device in accordance with the invention are steam injectors 30, for example in the floor 31 of the chamber 15, which can be blocked by means of a controllable valve 32 (or a controllable valve each), or provided with more or less steam from an appropriate steam source 33. A first regulator 34 is preferably assigned to the ventilator 28 and the steam injectors 30, which is intended to regulate the chamber climate as a function of the climatic values—steam content of the air in the chamber 15—obtained by the control measuring device 35 arranged in the chamber 15. The first regulator 34 then should either reduce the steam content of the chamber climate by starting the ventilator 28 or increasing the ventilator rpm, or increase it by putting the steam injectors 30 into operation. Therefore the first regulator 34 is a part of a first control circuit for regulating the chamber climate with the aid of the ventilator 28 or the steam injectors 30 as a function of the value of the steam content of the chamber air determined by means of the climate measuring device 35.

Further preferred characteristics of the device in accordance with the invention are the recirculating fans 36 disposed in the chamber 14 (if required preferably in each chamber) and an outlet measuring device 37, positioned at the goods outlet 17 or immediately after it, for the residual moisture. The latter is connected to a second regulator 38, which controls the recirculating fan(s) 36. Thus, together with the recirculating fan 36 and the outlet measuring device 37 for the residual moisture, the second regulator 38 forms a second control circuit.

The first control circuit with the first regulator 34 includes the chamber climate measuring device 35, which not only controls the motor of the ventilator 28 of the draw-off conduit 24, but also—alternatively—the valves 32 of the steam injectors 30. It is therefore possible by means of the first regulator 34 to regulate the steam content of the air in the chamber 15 independently of which amount of moisture—instantaneous or as a function of the goods—is conveyed with the goods 6 into the chamber 15. For example, the amount of moisture also greatly depends on the weight of the goods. A lot of moisture is brought into the chamber 15 by heaye goods, little moisture by light goods. The moisture can be reduced by means of the draw-off conduit 24. Therefore an important aspect of the invention lies in that steam injectors 30 are provided alternatively to the draw-off conduit 24. The steam content of the air in the chamber 15 can be increased with the aid of the steam injectors 30 in case the incoming goods 6 do not bring sufficient moisture into the chamber.

An aspect of the method which is performed by the device in accordance with the invention lies in assuring a defined retention time of the goods 6 in the chamber 15. During the entire retention time the goods must be at least moist enough so that the applied dye liquor can react with the cellulose fibers or the like. Since at the inlet of the chamber, at the goods inlet 16, the goods practically come directly out of the padding machine 7, they generally have sufficient residual moisture there. If this should not be the case, the moistening device 12 can be switched on. An inlet measuring device 39 for residual moisture can therefore be provided at the goods inlet for the possible control of the goods 6.

As mentioned, the device in accordance with the invention makes it possible to keep the goods 6 sufficiently moist until the chamber outlet, the goods outlet 17, so that the system of goods and applied dye liquor remains ready to react to bind the dye to the cellulose fibers. In accordance with the invention, the second control circuit with the second regulator 38 is provided for controlling and maintaining this state. If, for example, the outlet measuring device 15 for residual moisture notes too little residual moisture, the recirculated amount of air is reduced via the second regulator 38 by reducing the rpm of the recirculating fan(s) 36, so that the goods dry more slowly.

If, for example, goods with 200 g/m$^2$ with 70% residual moisture enter the chamber 15 and leave the chamber with 15% residual moisture after the prescribed retention time, goods with only 100 g/m$^2$ and also 70% residual moisture at the chamber inlet (goods inlet 16) would have a residual moisture of 15% already inside the chamber—perhaps after approximately half the prescribed retention time—under otherwise equal conditions, and would thereafter be too dry for a further reaction between the dye liquor and the cellulose goods. To prevent this, the amount of recirculated air is reduced sufficiently far in the device in accordance with the invention via the regulator 38 by means of the rpm of the recirculating fans 36, so that the light goods leave the dryer with at least the same residual moisture of 15% as the heavy goods. For example, for this it can be necessary that the second regulator 38 reduces the rpm of the recirculating fans 36 to approximately half the value.

If, on the other hand, heavy goods of, for example 400 g/m$^2$, also enter the dryer with a residual moisture of 70%, the goods would leave the dryer with approximately 30% residual moisture, if the recirculating fans 36 are set in accordance with the goods of 200 g/m$^2$. In this case the retention time (of the goods ready for reaction) is maintained in any case. But it would be possible to increase the rpm of the recirculating fans 36—if this is possible—, so that faster drying would take place; however, the residual moisture with which the goods 6 leave the hot flue 14 has no effect on the result of the dye fixation, as long as the prescribed minimum moisture is present.

A device is provided by the invention, with which it is possible to execute a method for the dye fixation in reactive dyeing of cellulose goods or cellulose fibers of all types in a dye liquor containing auxiliaries for binding the reactive dye to the cellulose fibers, wherein in an air dryer the cellulose goods which are padded with the dye liquor can be subjected to a retentive treatment of predetermined length with a predetermined steam content of the air in the drying chamber. In the device the residual moisture of the cellulose goods is maintained at a value as far as the outlet of the chamber in which the reaction of the dyestuff with the cellulose fibers takes place. A defined steam content of the chamber air can simultaneously be continuously—even with light goods—regulated independently of the weight of the goods, i.e. also independently of the amount of water brought into the dryer with the goods.

List of Reference Numerals

1=Inlet area
2=Mandrels
3=Trough
4=High inlet
5=Conveying device
6=Goods
7=Dye padding machine
8=Liquor trough
9=Squeezer
10=Dye liquor
11=Air passage
12=Moistening device
13=Compensator
14=Hot flue
15=Chamber (14)
16=Goods inlet
17=Goods outlet
18=Guidance and conveying roller
19=Trough
20=High outlet
21=Mandrel
22=Compensator
23=Washing machine
24=Draw-of conduit
25=Floor inlet (24)
26=Ceiling inlet (24)
27=Outlet
28=Ventilator
29=Exhaust air
30=Steam injector
31=Floor
32=Valve
33=Steam source
34=First regulator
35=Climate measuring device
36=Recirculating fan
37=Outlet measuring device for residual moisture
38=Second regulator
39=Inlet measuring device for residual moisture.

I claim:

1. A device for dye fixing in connection with reactive dyeing of cellulose goods (6) with a padding machine (7) for applying a dye liquor (10) containing the reactive dyestuff to the goods (6), and with an air dryer (14) connected downstream of the padding machine (7) having a chamber (15) with a goods inlet and outlet (16, 17), as well as a controllable draw-off conduit (24) and a controllable recirculating fan (36), characterized in that the chamber (15) has adjustable steam injectors (30), that a climate measuring device (35), connected with the control means (34) of the draw-off conduit (24) and the steam injectors (30), is provided for regulating a preset steam content of the ambient air, and that at the goods outlet (17) an outlet measuring device (37) for the residual outlet moisture is assigned to the goods (6) in controlled connection with the recirculating fan (36) for regulating a residual moisture of the goods (6) still capable of reacting up to the goods outlet (17).

2. The device in accordance with claim 1, characterized by a first regulator (34) for regulating the chamber climate by the selective triggering of a ventilator (28) in the draw-off conduit (24) or of a valve (32) for blowing in steam through the steam injectors (30) as a function of a climate measurement in the chamber (15), and by a second regulator (38) for regulating the amount of recirculated air by means of the recirculating fan (36) as a function of an outlet measurement of the residual moisture in the goods (6).

3. The device in accordance with claim 1, characterized in that the draw-off conduit (24) has a ventilator (28) with an rpm-regulated drive motor.

4. The device in accordance with claim 1, characterized in that an air passage (11), which is short in respect to the retention time of the goods (6), is inserted between the padding machine outlet and the goods inlet (16) of the air dryer (14).

5. The device in accordance with claim 1, characterized in that an inlet measuring device (39) for residual moisture is assigned to the goods (6) at or directly ahead of the goods inlet (16) of the chamber (15).

6. The device in accordance with claim 1, characterized in that at least one hot flue (14) is provided as the air dryer.

7. A method for dye fixing in connection with reactive dyeing of cellulose goods (6) with a padding machine (7) for applying a dye liquor (10) containing the reactive dyestuff to the goods (6), and with an air dryer (14) connected downstream of the padding machine (7) having a chamber 15 with a goods inlet and outlet (16, 17), as well as a controllable draw-off conduit (24) and a controllable recirculating fan (36), the method comprising the steps of: using a dye liquor (10) containing sodium bicarbonate which contains reaction dye and only wetting agents as auxiliaries for binding the dye to the fibers of the goods (6), and providing climate and residual moisture measuring devices (35, 37) assigned to the chamber (15) and the goods (6), and regulators (34, 35) of the draw-off conduit (24) and steam injectors (30) and a recirculating fan (36) for assuring a retention treatment of a predetermined length of approximately two minutes, of the reaction-ready moist goods (6) in the air dryer with a predetermined steam content of the air of approximately 25 vol-%.

8. A device for dye fixing in connection with reactive dyeing of cellulose goods (6) with a padding machine (7) for applying a dye liquor (10) containing the reactive dyestuff to the goods (6), and with an air dryer (14) connected downstream of the padding machine (7) having a chamber 15 with a goods inlet and outlet (16, 17), as well as a controllable draw-off conduit (24) and a controllable recirculating fan (36), characterized in that, the chamber (15) has adjustable steam injectors (30), that a climate measuring device (35), connected with the control means (34) of the draw-off conduit (24) and the steam injectors (30), is provided for regulating a preset steam content of the ambient air, and that at the goods outlet (17) an outlet measuring device (37) for the residual outlet moisture is assigned to the goods (6) in controlled connection with the recirculating fan (36) for regulating a residual moisture of the goods (6) still capable of reacting up to the goods outlet (17), and wherein the control means comprises a first regulator (34) for regulating the chamber climate by the selective triggering of a ventilator (28) in the draw-off conduit (24) or of a valve (32) for blowing in steam through the steam injectors (30) as a function of a climate measurement in the chamber (15), and further including a second regulator (38) for regulating the drying output by means of the recirculating fan (36) as a function of an outlet measurement of the residual moisture in the goods (6).

9. The device in accordance with claim 8, characterized in that the draw-off conduit (24) has a ventilator (28) with an rpm-regulated drive motor.

10. The device in accordance with claim 8, characterized in that an air passage (11), which is short in respect to the retention time of the goods (6), is inserted between the padding machine outlet and the goods inlet (16) of the air dryer (14).

11. The device in accordance with claim 8, characterized in that an inlet measuring device (39) for residual moisture is assigned to the goods (6) at or directly ahead of the goods inlet (16) of the chamber (15).

12. The device in accordance with claim 8, characterized in that at least one hot flue (14) is provided as the air dryer.

13. A method for dye fixing in connection with reactive dyeing of cellulose goods (6) with a padding machine (7) for applying a dye liquor (10) containing the reactive dyestuff to the goods (6), and with an air dryer (14) connected downstream of the padding machine (7) having a chamber 15 with a goods inlet and outlet (16, 17), as well as a controllable draw-off conduit (24) and a controllable recirculating fan (36), the method comprising the steps of:

applying a dye liquor containing a weak alkali including a reaction dye and a wetting agent;

providing climate and residual moisture measuring devices (35, 37) assigned to the chamber (15) and the goods (6), and regulators (34, 35) of the draw-off conduit (24) and steam injectors (30) and a recirculating fan (36) for keeping the goods sufficiently moist whereby the applied dye liquor remains ready to react to bind the dye to the cellulose fibers; and retaining the goods in the chamber for a retention treatment time of a predetermined length in the air dryer with a predetermined steam content of the air for providing excellent dyeing results.

14. The method of claim 13, wherein the predetermined retention treatment time is approximately two minutes.

15. The method of claim 13, wherein the predetermined steam content is approximately 25 vol-%.

* * * * *